US009157274B2

(12) United States Patent
Cheng

(10) Patent No.: US 9,157,274 B2
(45) Date of Patent: Oct. 13, 2015

(54) WINDOW COVERING

(71) Applicant: Li-Ming Cheng, Kaohsiung (TW)

(72) Inventor: Li-Ming Cheng, Kaohsiung (TW)

( * ) Notice: Subject to any disclaimer, the term of this patent is extended or adjusted under 35 U.S.C. 154(b) by 0 days.

(21) Appl. No.: 14/168,768

(22) Filed: Jan. 30, 2014

(65) Prior Publication Data

US 2015/0101764 A1 Apr. 16, 2015

(30) Foreign Application Priority Data

Oct. 15, 2013 (CN) ..... 2013 2 0635739

(51) Int. Cl.

| | |
|---|---|
| ***E06B 3/48*** | (2006.01) |
| ***E06B 9/66*** | (2006.01) |
| ***E06B 9/44*** | (2006.01) |
| ***E06B 9/64*** | (2006.01) |
| ***E06B 9/322*** | (2006.01) |
| ***E06B 9/323*** | (2006.01) |
| ***E06B 9/327*** | (2006.01) |
| *E06B 9/326* | (2006.01) |

(52) U.S. Cl.

CPC . *E06B 9/66* (2013.01); *E06B 9/322* (2013.01); *E06B 9/323* (2013.01); *E06B 9/327* (2013.01); *E06B 9/44* (2013.01); *E06B 9/64* (2013.01); *E06B 9/326* (2013.01); *E06B 2009/3222* (2013.01)

(58) Field of Classification Search

CPC ..... E06B 9/322; E06B 9/325; E06B 9/521; E06B 9/262; E06B 2009/3222; E06B 2009/2625; E06B 2009/2627

USPC ..... 160/167 R, 167 V, 170, 171, 368.1, 160/84.01, 84.02, 84.04, 84.05

See application file for complete search history.

(56) References Cited

U.S. PATENT DOCUMENTS

| | | | | |
|---|---|---|---|---|
| 6,029,734 | A * | 2/2000 | Wang et al. | 160/170 |
| 7,373,965 | B2 | 5/2008 | Cheng | |
| 7,575,036 | B2 * | 8/2009 | Cheng | 160/170 |
| 2008/0099159 | A1 * | 5/2008 | Nien | 160/170 |
| 2013/0032300 | A1 * | 2/2013 | Yu et al. | 160/84.02 |
| 2014/0048220 | A1 * | 2/2014 | Cheng | 160/368.1 |
| 2014/0076504 | A1 * | 3/2014 | Anthony et al. | 160/84.04 |
| 2014/0217142 | A1 * | 8/2014 | Lin | 226/196.1 |
| 2014/0262063 | A1 * | 9/2014 | Huang | 160/84.02 |

FOREIGN PATENT DOCUMENTS

WO WO 2012154871 A1 * 11/2012

* cited by examiner

*Primary Examiner* — Katherine Mitchell
*Assistant Examiner* — Abe Massad
(74) *Attorney, Agent, or Firm* — Muncy, Geissler, Olds & Lowe, P.C.

(57) ABSTRACT

A window covering comprises an upper rail, a window shade located below the upper rail, a lower rail located below the window shade, a first clamping assembly and a second clamping assembly located at two sides of the lower rail and spaced from each other, and a cord winding assembly located in the lower rail to connect to the first clamping assembly and the second clamping assembly. A first cord and a second cord run through two opposite sides of the window shade to fasten to the cord winding assembly. The lower rail can be moved upwards or downwards by a user to retract or expand the window shade through the first and second cord. Besides, the distal ends of the first and second cords can be hidden in the cord winding assembly in the lower rail, thus can prevent the cords from entangling children to avoid accidents.

8 Claims, 12 Drawing Sheets

WINDOW COVERING

FIELD OF THE INVENTION

The present invention relates to a window covering and particularly to a window covering with concealed cords.

BACKGROUND OF THE INVENTION

There are numerous types of window coverings available on the market, such as Venetian blinds, pleated window shades, Roman shades and the like. They are mainly installed on doors and windows of houses to meet different consumers' requirements such as blocking sunshine and providing decoration function.

The general window covering has cords that can be lifted upwards and downwards to control retraction and extension thereof. For instance, U.S. Pat. No. 7,373,965 discloses a window covering 10 that mainly comprises a seat 11, a control switch 12 and a cord assembly 13, as shown in FIGS. 1 and 2. The cord assembly 13 has cords 131 converged to run through a bottom hole of the seat 11, an aperture on an anchor member of the control switch 12, and an opening of a depressing member 121 of the control switch 12, so that a lower end of each cord 131 are converged below the seat 11 and movements of the cords 131 can be controlled by the control switch 12. During retraction of the window covering 10 a user has to press the depressing member 121 of the control switch 12 with one hand and pull the lower end of each cord 131 with another hand to finish retraction of the window covering 10 (referring to FIG. 3). However, after retraction a lengthy portion of the cords 131 are exposed without a winding or concealing design. They could easily become a playing object of children and result in the risk of strangling the children.

SUMMARY OF THE INVENTION

The primary object of the present invention is to solve the problem of conventional window coverings with exposed cords that could result in environmental safety concern to children by providing a window covering with cords wound and held in a lower rail.

To achieve the foregoing object the invention provides a window covering which comprises an upper rail, a window shade located below the upper rail and including a first cord and a second cord, a lower rail located below the window shade, a first clamping assembly and a second clamping assembly located at two sides in the lower rail and spaced from each other, and a cord winding assembly located in the lower rail and including one side connected to the first clamping assembly and another side connected to the second clamping assembly. The first cord and the second cord respectively have an upper end threading through and fastened to a lower end of the upper rail, and a lower end threading through the window shade, and the interior of the lower rail to fasten to the cord winding assembly.

The invention, by means of the construction set forth above, compared with the conventional techniques, provides many advantages, notably:

Through the first cord and second cord threading through the upper rail, window shade and interior of the lower rail to connect to the cord winding assembly, they are held and concealed inside the cord winding assembly in the lower rail during retraction of the window shade, hence the hazardous incident resulted from the cords entangling the children can be prevented.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
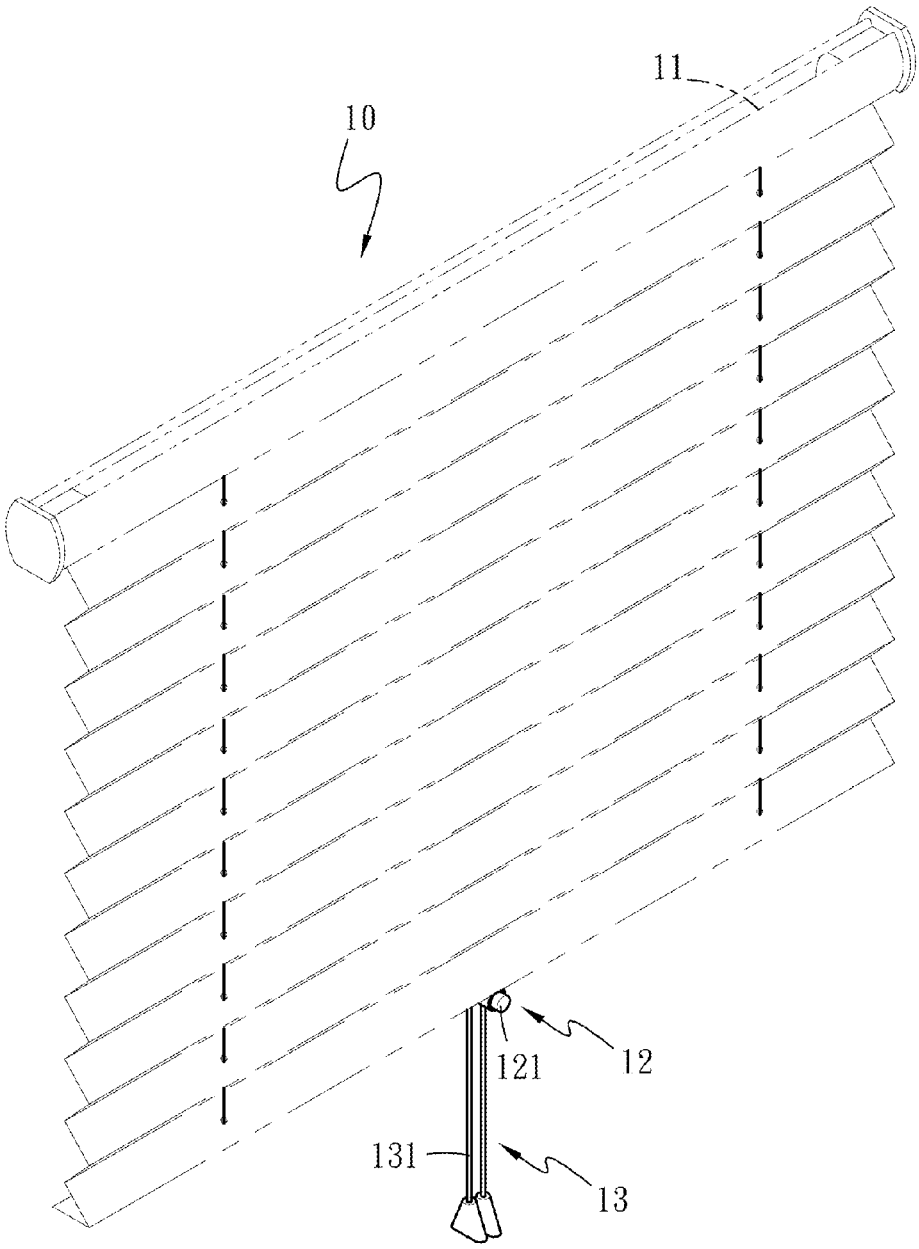
Fig. 1 PRIOR ART
FIG. 1 is a perspective view of a conventional window covering.
Figure 2:
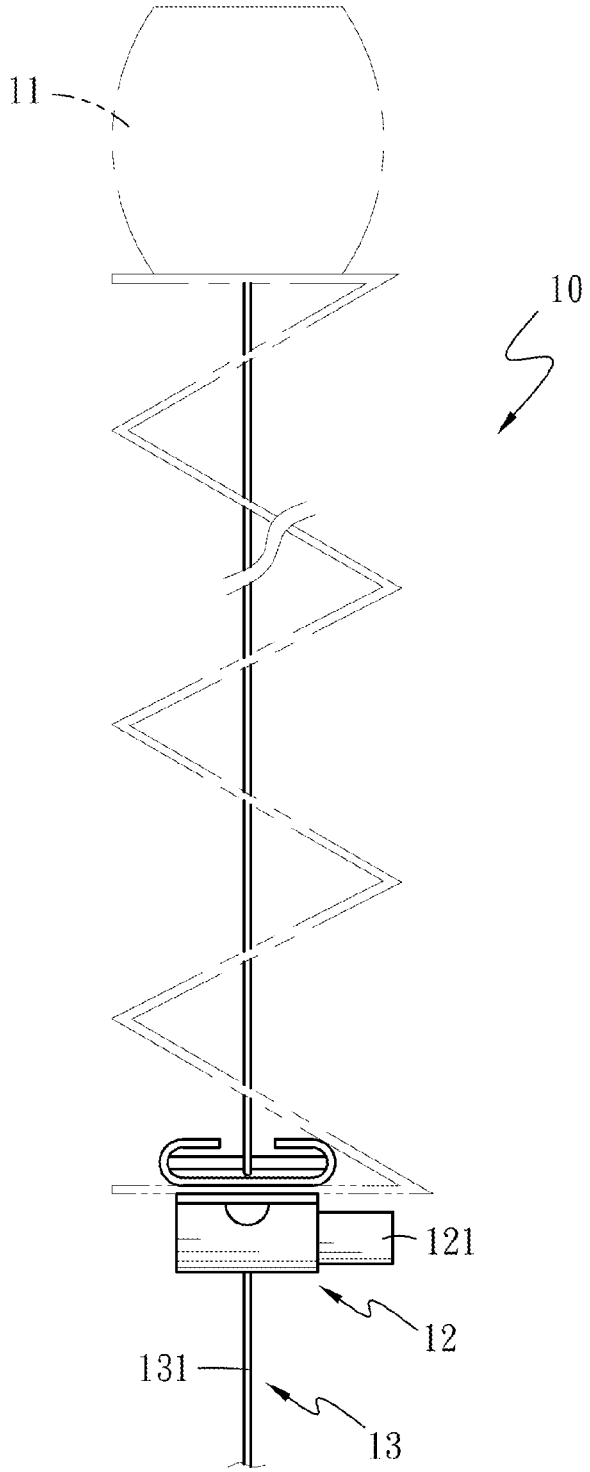
Fig. 2 PRIOR ART
FIG. 2 is a side view of the window covering of FIG. 1.
Figure 3:
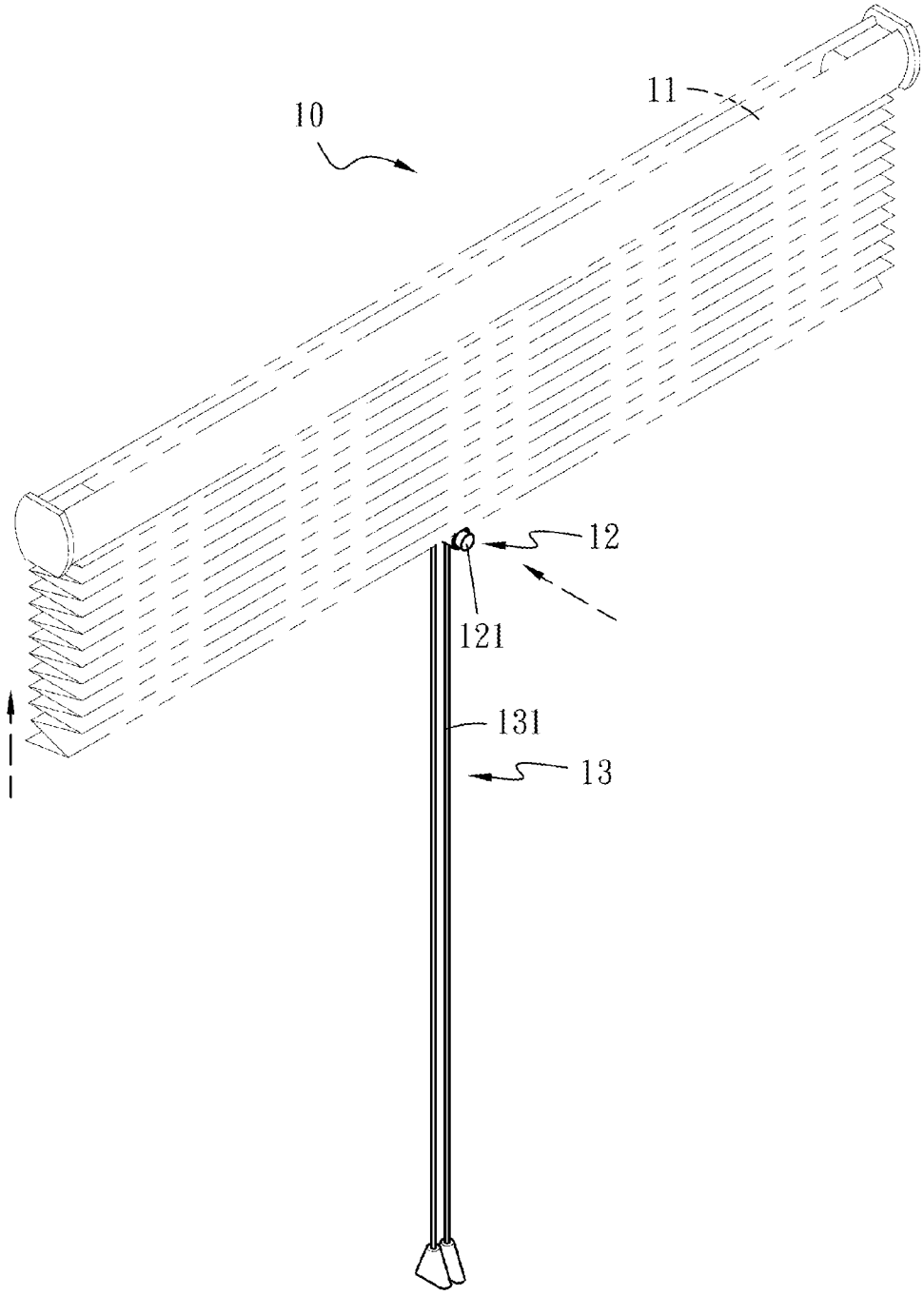
Fig. 3 PRIOR ART
FIG. 3 is a schematic view of the window covering of FIG. 1 in a retracted condition in which the control switch is pressed.
Figure 4:
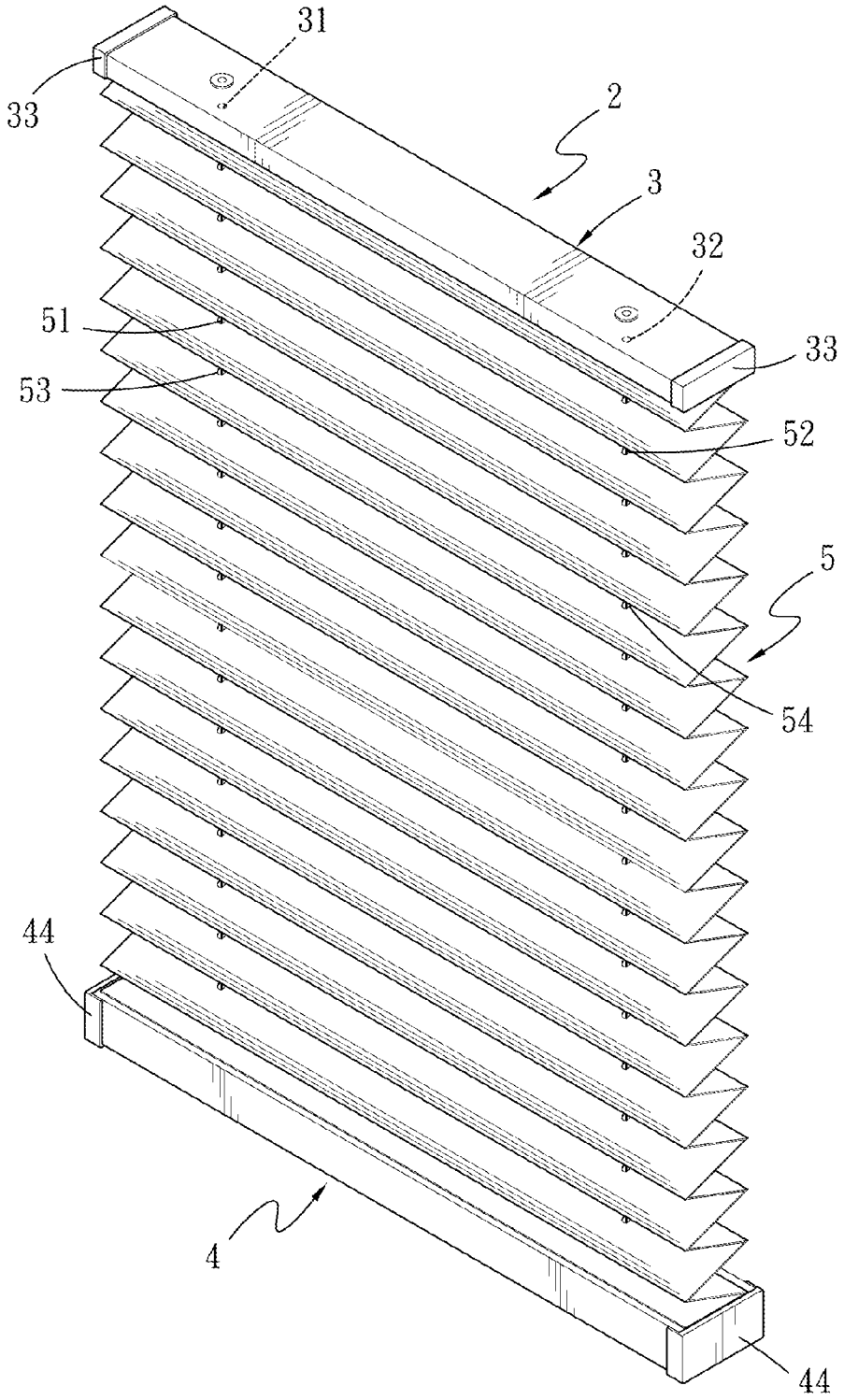
FIG. 4 is a perspective view of the invention in an extended condition.
Figure 5:
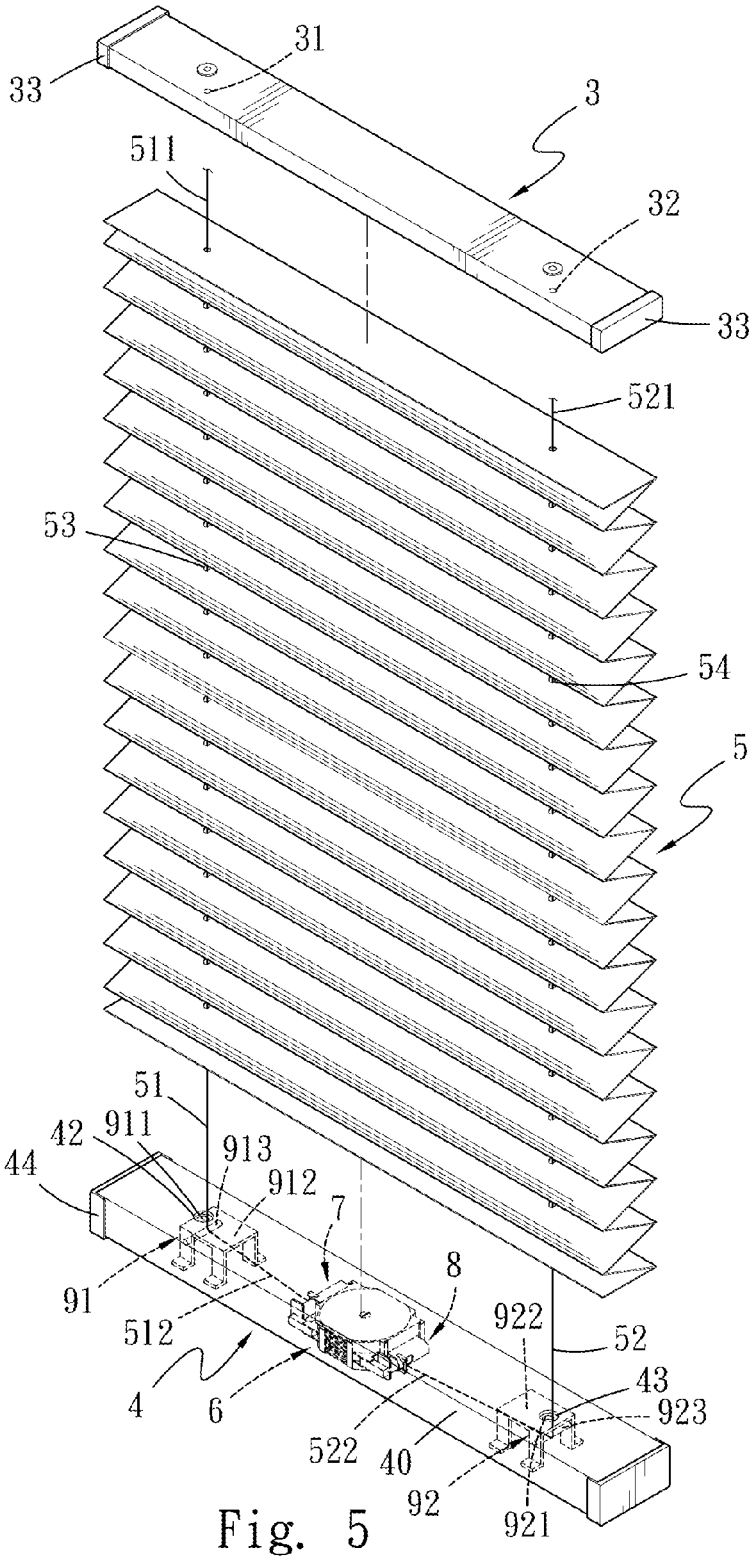
FIG. 5 is an exploded view of the invention showing that the cord winding assembly, the first clamping assembly and the second clamping assembly are held in the lower rail.

Please referring to FIGS. 4 through 6, the present invention aims to provide a window covering 2 that comprises an upper rail 3, a lower rail 4 located below and spaced from the upper rail 3, a foldable window shade 5 located between the upper rail 3 and the lower rail 4, and a cord winding assembly 6 which has two opposite sides respectively connected to a first clamping assembly 7 and a second clamping assembly 8.

The upper rail 3 includes a first threading hole 31 and a second threading hole 32, and two sides the upper rail 3 are respectively closed by wedging with a first sealing cap 33.

The lower rail 4 includes an elongate rail holder 40 with a holding trough 41 formed in the elongate rail holder 40, and a third threading hole 42 and a fourth threading hole 43 respectively corresponding to the first threading hole 31 and the second threading hole and 32, and two sides of the lower rail 4 are respectively closed by wedged with a second sealing cap 44.

The foldable window shade 5 includes a first cord 51 and a second cord 52, a plurality of first through holes 53 threaded through by the first cord 51, and a plurality of second through holes 54 threaded through by the second cord 52. The first cord 51 has an upper end 511 threading through the first threading hole 31 to fasten on the interior of the upper rail 3, and a lower end 512 threading through the first through holes 53 of the window shade 5 and the third threading hole 42 of the lower rail 4. The second cord 52 includes an upper end 521 threading through the second threading hole 32 to fasten on the interior of the upper rail 3, and a lower end 522 threading through the second through holes 54 of the window shade 5 and the fourth threading hole 43 of the lower rail 4.

The cord winding assembly 6, referring to FIGS. 7 through 9B, is located in the lower rail 4 and connected to the lower ends 512 and 522 of the first cord 51 and the second cord 52, and includes a body 61 and a pulley set 62. The body 61 includes a first housing 611, a holding strut 612 disposed in the first housing 611 and including a slot 613, an indented rim 614 which is formed on an upper portion of the first housing 611 and includes two wedge notches 6141 at each end of a diagonal location, and a sealing lid 65 wedged in the indented rim 614. The sealing lid 65 includes a first insertion hole 651 corresponding to the holding strut 612 and two wedge members 652 formed at a diagonal location of a bottom of the sealing lid 65 to correspondingly wedge in the wedge notches 6141, so as to fasten the sealing lid 65 to the intended rim 614 (referring to FIGS. 9A and 9B). The body 61 further has a first recess portion 615 on one lateral side thereof, a first detent member 6151 extended outwards from a front end of the body 61, a first hole 616 formed on the lateral side of the body 61 to communicate the first housing 611 with the first recess portion 615. Moreover, the body 61 includes a second recess portion 617 on another lateral side thereof remote from the first recess portion 615, a second detent member 6171 extended outwards from the front end of the body 61 and opposite to the first detent member 6151, and a second hole 618 formed on the another lateral side of the body 61 to communicate the first housing 611 with the second recess portion 617. The second hole 618 is formed at an elevation lower than the first hole 616.

Figure 11:
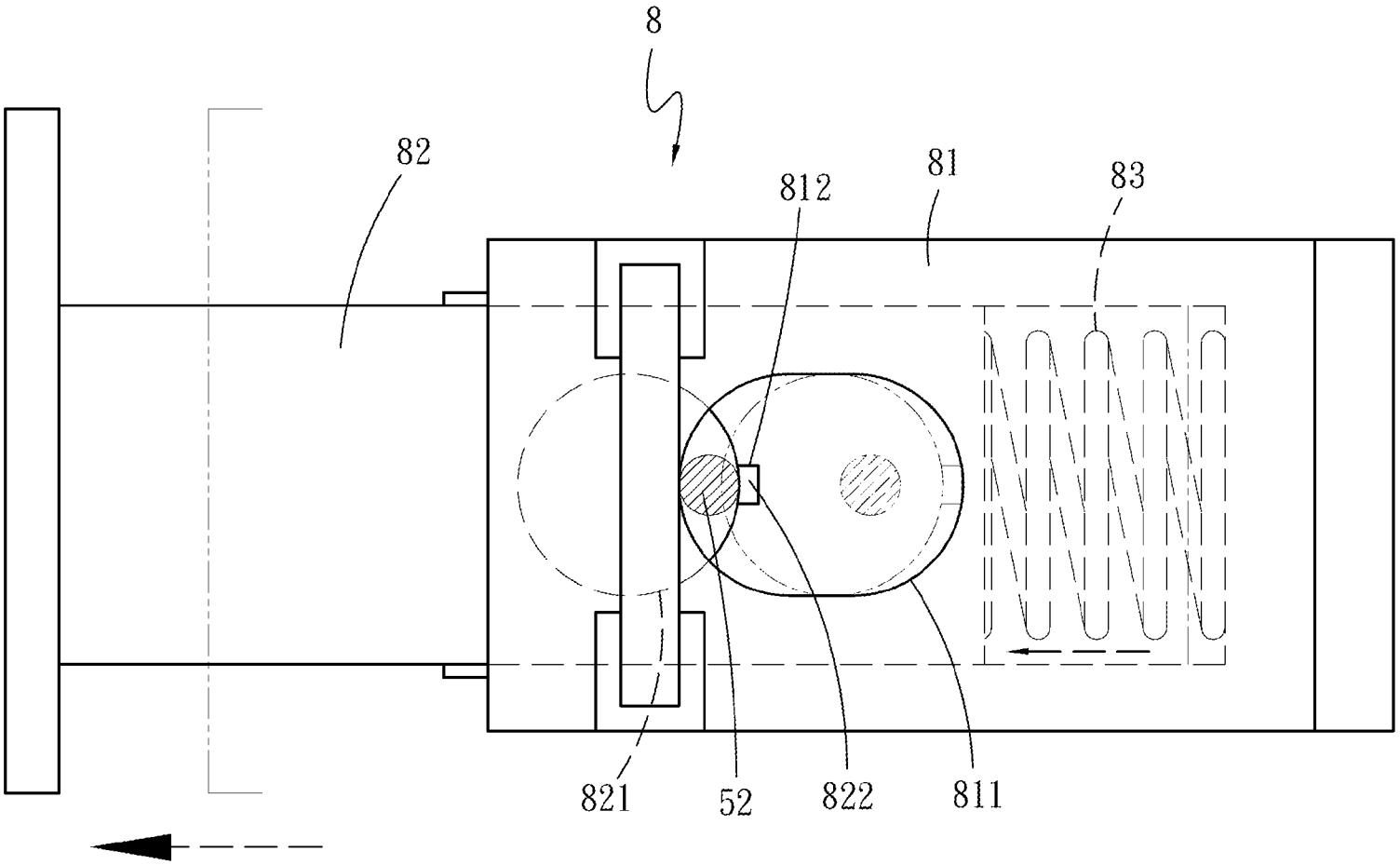
FIG. 11 is a side view of the invention showing movements of the second clamping assembly.

The pulley set 62 includes a winding spool 63 and a coil spring 64. The winding spool 63 includes a holding space 630 in the center thereof, a second insertion hole 631 formed at the bottom thereof and run through by the holding strut 612 of the body 61, and an upper holding trough 632 and a lower holding trough 633 formed on a periphery of the winding spool 63. The holding space 630 has a third hole 634 and a fourth hole 635 respectively formed at two opposite sides of an inner wall of the winding spool 63 and corresponding to the first hole 616 and the second hole 618 of the body 61 to respectively communicate with the upper holding trough 632 and the lower holding trough 633. The coil spring 64 is located in the holding space 630, and includes one end 641 latched on a latch slot 636 formed on the inner wall of the winding spool 63 and another end 642 latched in the slot 613 of the holding strut 612;

Please refer to FIGS. 9A through 11, the first clamping assembly 7 and the second clamping assembly 8 are respectively connected to two sides of the cord winding assembly 6, and are positioned at a higher and a lower elevations to align with the first hole 616 and the second hole 618 of the body 61 respectively. The first clamping assembly 7 includes a first sleeve 71 which includes a first wedge flange 710 at one side of the first sleeve 71 to wedge in the first recess portion 615 of the body 61, two first apertures 711 formed on two sides of the first sleeve 71 and corresponding to the first hole 616, two opposite first ditches 712 formed on an inner rim of the first sleeve 71, and a first guide bar 713 extended from an outer side of the first sleeve 71 and adjacent to one of the first apertures 711 to guide the lower end 512 of the first cord 51. The first sleeve 71 has a hollow interior to hold and couple to a movable first slide member 72. The first slide member 72 includes an outer end abutting the first detent member 6151, two first bores 721 formed on two sides thereof and corresponding to the two first apertures 711, and two first bosses 722 protruded from the two sides thereof and corresponding to the two first ditches 712, so that the two first bosses 722 are movably latched in the two first ditches 712 to prevent the first slide member 72 from separating after assembly. A first elastic element 73 is disposed between the first sleeve 71 and a first recess 723 of the first slide member 72, so as to allow the first slide member 72 to be pressed or released. The second clamping assembly 8 includes a second sleeve 81 which includes a second wedge flange 810 at one side of the second sleeve 81 to wedge in the second recess portion 617 of the body 61, two second apertures 811 formed on two sides of the second sleeve 81 corresponding to the second hole 618, two opposite second ditches 812 formed on an inner rim of the second sleeve 81, and a second guide bar 813 extended from an outer side of the second sleeve 81 and adjacent to one of the second apertures 811 to guide the lower end 522 of the second cord 52. The second sleeve 81 has a hollow interior to hold and couple to a movable second slide member 82. The second slide member 82 includes an outer end abutting the second detent member 6171, two second bores 821 formed on two sides thereof and corresponding to the two second apertures 811, and two second bosses 822 protruded from the two sides thereof and corresponding to the two second ditches 812, so that the two second bosses 822 are movably latched in the two second ditches 812 to prevent the second slide member 82 from separating after assembly (referring to FIGS. 10A through 10C). A second elastic element 83 is disposed between the second sleeve 81 and a second recess 823 of the second slide member 82 to allow the second slide member 82 to be pressed or released (as shown in FIG. 11). The first elastic elements 73 and the second elastic element 83 can be springs or other elastic and extensible materials, thereby when the first slide member 72 and the second slide member 82 are pressed, they can be movable and extensible in the first sleeve 71 and the second sleeve 81 respectively, meanwhile to release or brake the first cord 51 and the second cord 52.

The window covering 2 further includes a first roller assembly 91 and a second roller assembly 92 that are fixedly located inside the elongate rail holder 40 of the lower rail 4 and positioned at two sides of the cord retraction assembly 6 in a symmetrical manner. Please refer to FIGS. 5 and 6, the first roller assembly 91 includes a first bracing seat 912, a first opening 911 formed on a top surface of the first bracing seat 912 and corresponding to the third threading hole 42, and a first guide rod 913 disposed at one side of the first bracing seat 912 and adjacent to the first opening 911 to allow the first cord 51 to wind around the first guide rod 913 to facilitate stretching. The second roller assembly 92 includes a second bracing seat 922, a second opening 921 formed on a top surface of the second bracing seat 922 and corresponding to the fourth threading hole 43, and a second guide rod 923 disposed at one side of the second bracing seat 922 and adjacent to the second opening 921 to allow the second cord 52 to wind around the second guide rod 923 to facilitate stretching.

Figure 6:
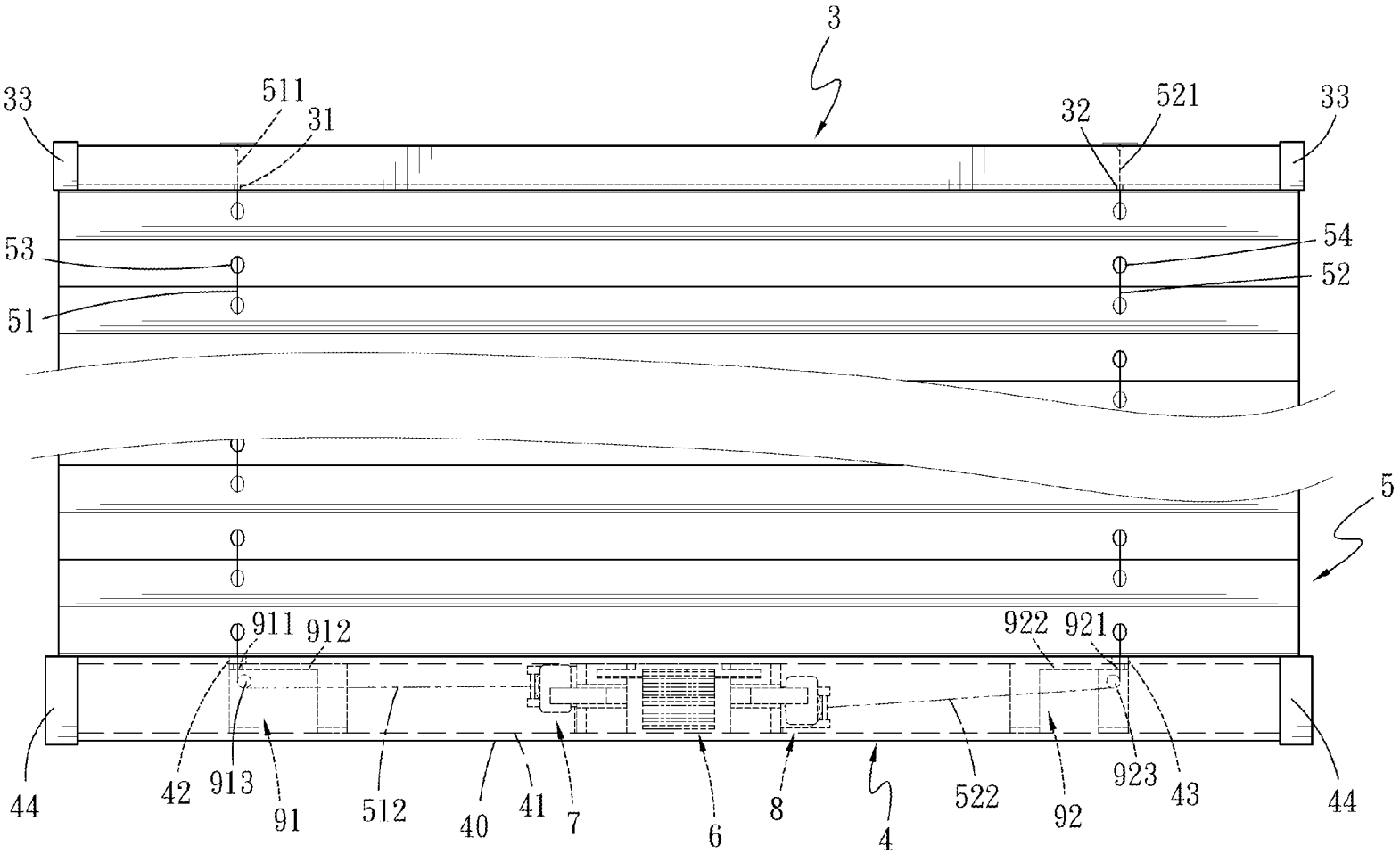
FIG. 6 is a front view of the cord winding assembly, the first clamping assembly and the second clamping assembly of the invention.
Figure 7:
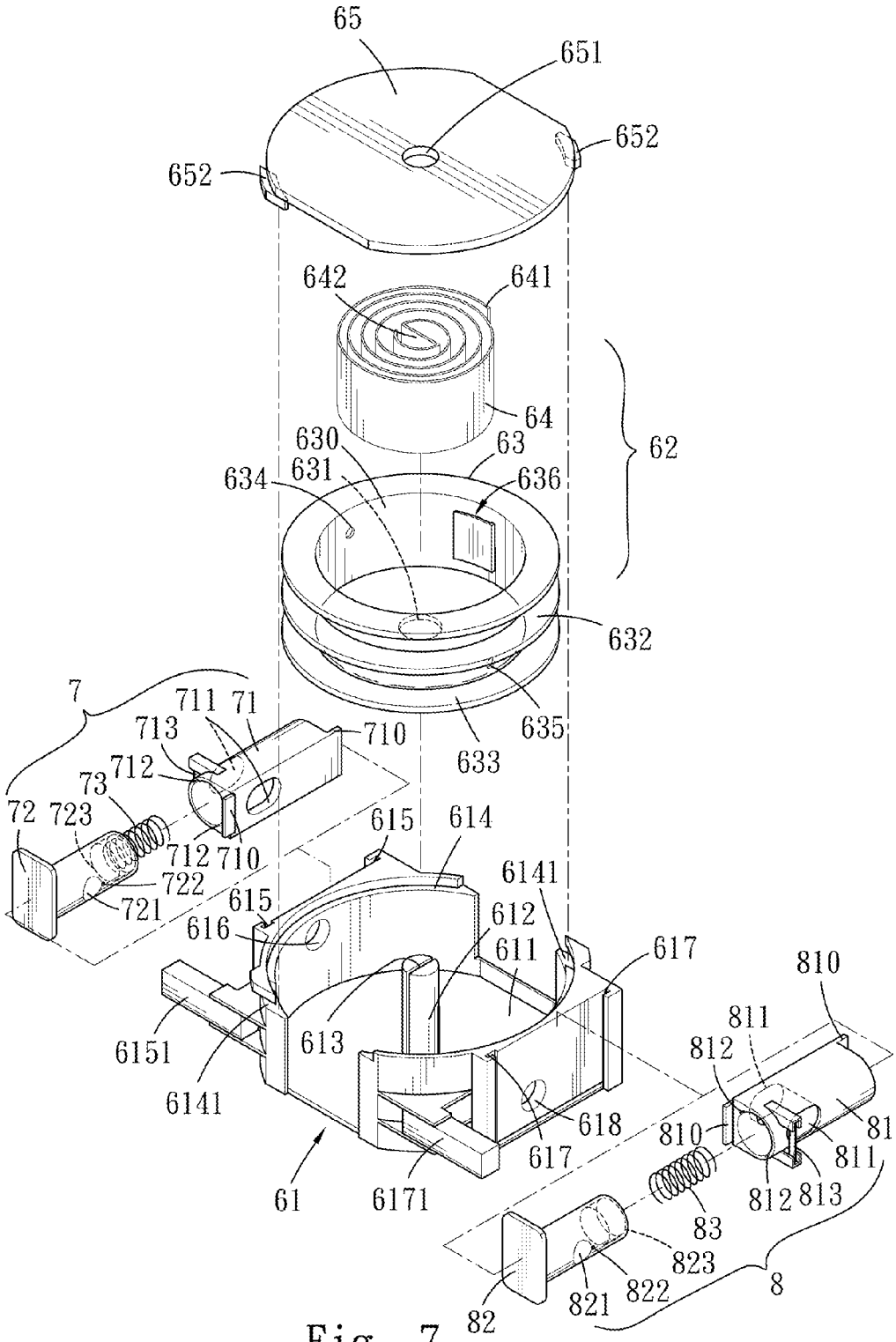
FIG. 7 is an exploded view of the cord winding assembly, the first clamping assembly and the second clamping assembly of the invention.
Figure 8:
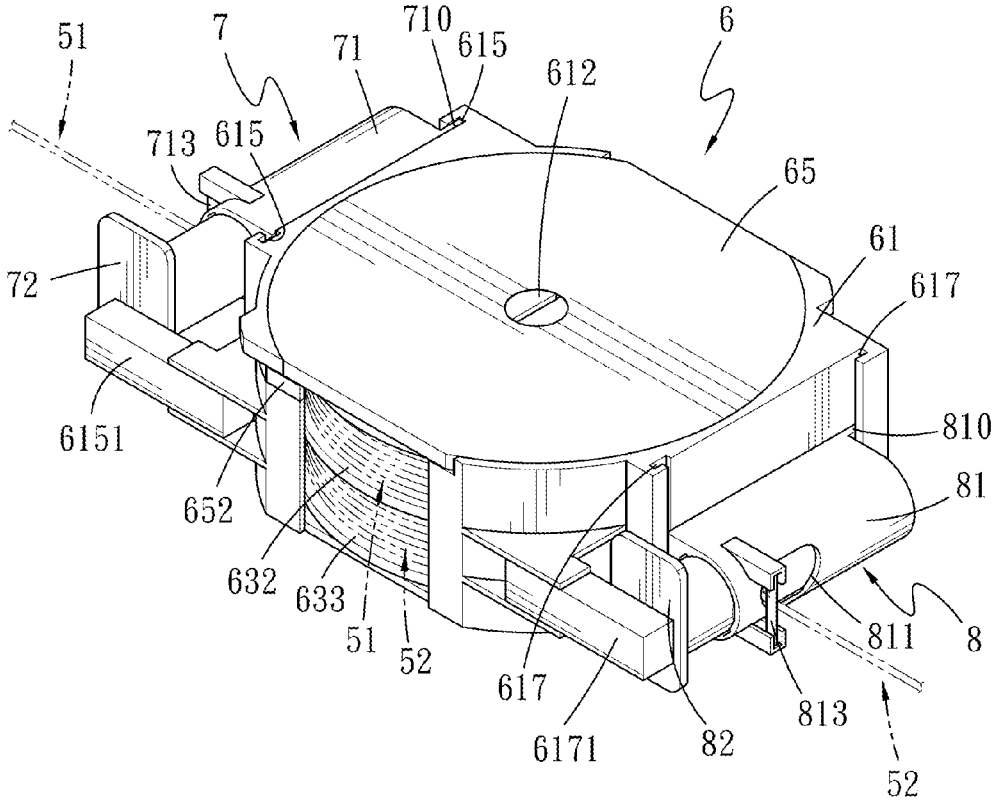
FIG. 8 is a perspective view showing the cord winding assembly, the first clamping assembly and the second clamping assembly of the invention after being assembled.
Figure 9B:
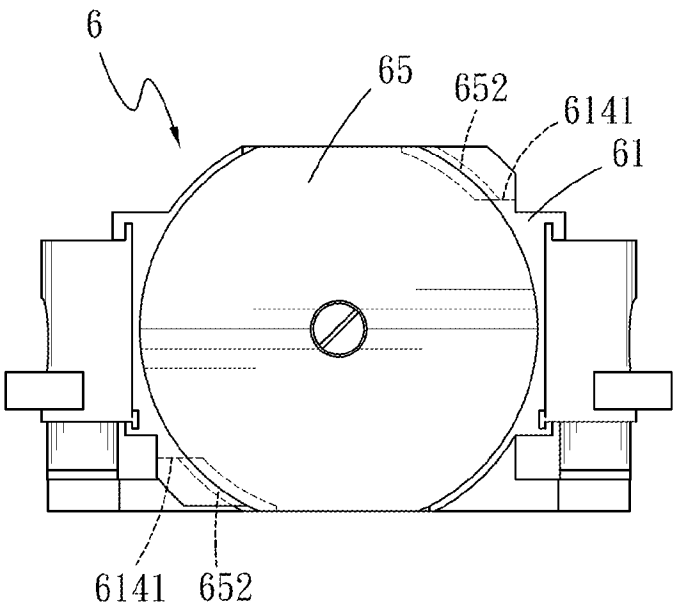
FIG. 9B is a schematic top view of the sealing lid of the cord winding assembly after wedging in the body according to the invention.
Figure 9A:
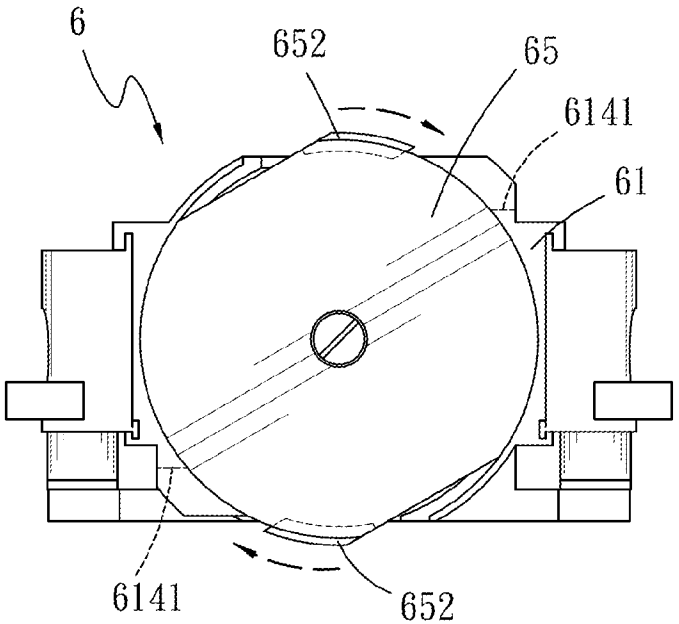
FIG. 9A is a schematic top view of the sealing lid of the cord winding assembly before wedging in the body according to the invention.
Figure 10B:
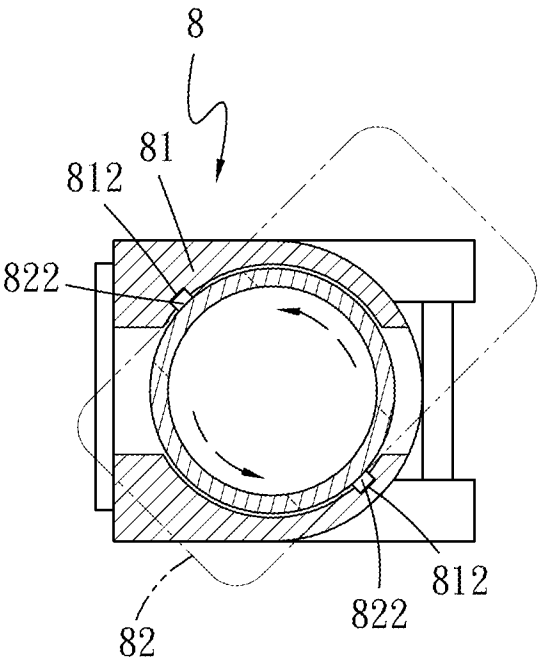
FIG. 10B is a schematic front view of the second clamping assembly showing how the second slide member swivels in the second sleeve according to the invention.
Figure 10A:
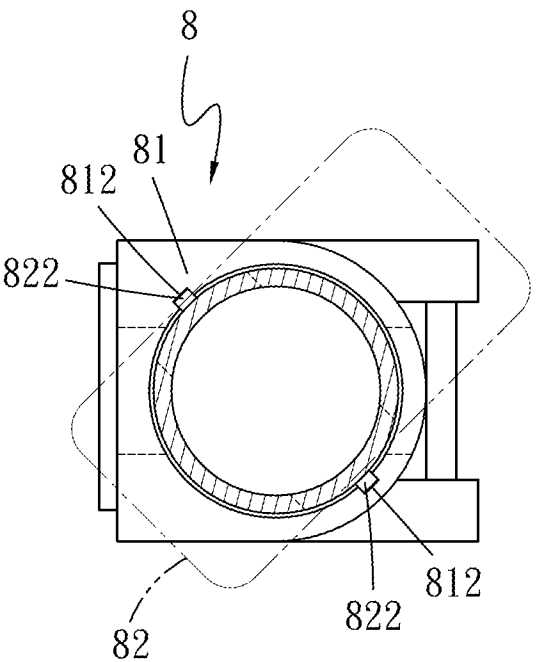
FIG. 10A is a schematic front view of the second clamping assembly before the second slide member moved into the second sleeve according to the invention.
Figure 10C:
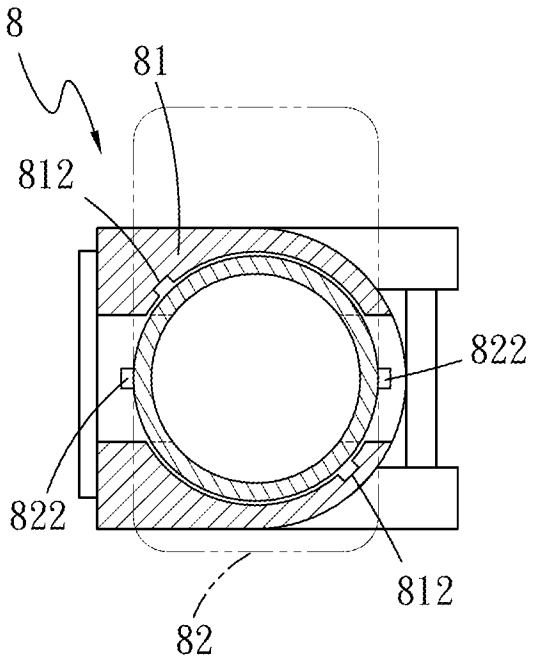
FIG. 10C is a schematic front view of the second clamping assembly after the second slide member anchored in the second sleeve according to the invention.

Referring to FIGS. 6 through 8, after the lower end 512 of the first cord 51 threaded through the third threading hole 42, it can wind on the first guide rod 913 of the first roller assembly 91, and passes through the two first apertures 711 of the first sleeve 71, the two first bores 721 of the first slide member 72, the first hole 616 of the body 61, and finally threads through and winds on the upper holding trough 632 of the winding spool 63 and fasten thereon. After the lower end 522 of the second cord 52 threaded through the fourth threading hole 43, it can wind on the second guide rod 923 of the second roller assembly 92, and passes through the two second apertures 811 of the second sleeve 81, the two second bores 821 of the second slide member 82, the second hole 618 of the body 61, and finally threads through and winds on the lower holding trough 633 of the winding spool 63 and fasten thereon.

When retracting or extending the window covering 2 is desired, user can pull the lower rail 4 downwards, hence the first and second cords 51 and 52 are movable and can be stretched to turn the upper trough 632 and the lower holding trough 633 of the winding spool 63 held in the body 61, and also tighten the coil spring 64 latched in the latch slot 636 of the winding spool 63 and the slot 613 of the holding strut 612. When the window shade 5 is extended to a length required, it is released and anchored. Meanwhile, as shown in FIG. 11, the first slide member 72 and the second slide member 82 are moved to their original positions due to the elastic forces of the first elastic element 73 and the second elastic element 83. Then the first cord 51 is clamped and held by the corresponding inner rims of the two first apertures 711 of the first sleeve 71 and the two first bores 721 of the first slide member 72. Similarly, the second cord 52 is clamped and held by and the corresponding inner rims of the two second apertures 811 of the second sleeve 81 and the two second bores 821 of the second slide member 82. Thus, the first cord 51 and the second cord 52 can be clamped and anchored to restrict their movement. Therefore, when the lower rail 4 is pushed upwards or moving downwards by the user, the first cord 51 and the second cord 52 can make the window shade 5 retracting upward or extending downward (referring to FIG. 6). Moreover, the first cords 51 and the second cord 52 are held in the cord winding assembly 6 and concealed in the lower rail 4 without exposing, thus the hazardous accident caused by entangling the children can be avoided, and the window shade also can block sunshine or serve as an ornamental.

What is claimed is:

1. A window covering, comprising:

an upper rail;

a window shade which is located below the upper rail and includes a first cord and a second cord;

a lower rail located below the window shade;

a cord winding assembly which is located in the lower rail and includes a body, the body including a first housing formed inside the body and a first recess portion and a second recess portion that are located on two opposite lateral sides of the body respectively, the first recess portion including a first hole for communicating the first housing with the first recess portion, the second recess portion including a second hole for communicating the first housing with the second recess portion;

a first clamping assembly, located in the lower rail and including a first sleeve, a first slide member slidably held inside the first sleeve and a first elastic element which is disposed in the first sleeve and abuts the first slide member, the first sleeve including a first wedge flame to wedge in the first recess portion of the body and two first apertures corresponding to the first hole, the first slide member including two first bores corresponding to the two first apertures of the first sleeve respectively; and a second clamping assembly, located in the lower rail and including a second sleeve, a second slide member slidably held inside the second sleeve and a second elastic element which is disposed in the second sleeve and abuts the second slide member, the second sleeve including a second wedge flange to wedge in the second recess portion of the body and two second apertures corresponding to the second hole, the second slide member including two second bores corresponding to the two second apertures of the second sleeve respectively;

wherein the first cord includes an upper end threading through and fastened to a lower end of the upper rail and a lower end which threads through the window shade, the interior of the lower rail, the two first apertures and the two first bores of the first clamping assembly and the first hole of the body to fasten to the cord winding assembly, and wherein the second cord includes an upper end threading through and fastened to a lower end of the upper rail and a lower end which threads through the window shade, the interior of the lower rail, the two second apertures and the two second bores of the second clamping assembly and the second hole of the body to fasten to the cord winding assembly;

wherein the body further includes a first detent member which extends towards the first recess portion to contact one end of the first slide member remote from the first elastic element and a second detent member which extends towards the second recess portion to contact one end of the second slide member remote from the remote elastic element, the first slide member being pushed by the first elastic element and blocked by the first detent member simultaneously so that the two first bores and the two first apertures keep overlapping with each other to movable hold the first cord, the second slide member being pushed by the second elastic element and blocked by the second detent member simultaneously so that the two second bores and the two second apertures keep overlapping with each other to movably hold the second cord.

2. The window covering of claim 1, wherein the cord winding assembly further includes a pulley set, and wherein:

the body includes a holding strut disposed in the first housing and including a slot, an indented rim formed on an upper portion of the first housing, a sealing lid wedged in the indented rim and including a first insertion hole corresponding to the holding strut; and the pulley set includes a winding spool and a coil spring, the winding spool including a holding space in the center thereof, a second insertion hole at the bottom thereof run through by the holding strut of the body, and an upper holding trough and a lower holding trough on the periphery thereof, the coil spring being held in the holding space and including one end latched on a latch slot formed on an inner wall of the winding spool and another end latched on the slot of the holding strut.

3. The window covering of claim 2, wherein the first sleeve includes two opposing first ditches disposed on an inner rim of the first sleeve, and a first guide bar extended from an outer side of the first sleeve and adjacent to one of the two first apertures to guide the lower end of the first cord, and wherein the first slide member includes two first bosses protruded from the two sides of the first slide member and corresponding to the two first ditches.

4. The window covering of claim 3, wherein the second sleeve includes two opposite second ditches disposed on an inner rim of the second sleeve and a second guide bar extended from at an outer side of the second sleeve and adjacent to one of the two second apertures to guide the lower end of the second cord, and wherein the second slide member includes two second bosses protruded from the two sides of the second slide member and corresponding to the two second ditches.

5. The window covering of claim 1, wherein the upper rail includes a first threading hole and a second threading hole penetrating through the bottom thereof and threaded through by the first cord and the second cord respectively for fastening on the upper rail.

6. The window covering of claim 5, wherein the lower rail includes a third threading hole and a fourth threading hole respectively corresponding to the first threading hole and the second threading hole and threaded through respectively by the first cord and the second cord.

7. The window covering of claim 6, wherein the lower rail includes a first roller assembly and a second roller assembly disposed at two sides of the cord winding assembly and corresponding to the third threading hole and the fourth threading hole to be wound by the first cord and the second cord respectively.

8. The window covering of claim 7, wherein the first roller assembly and the second roller assembly include respectively a first bracing seat and a second bracing seat, a first opening and a second opening on a top surface of the first bracing seat and the second bracing seat and corresponding to the third threading hole and the fourth threading hole, and a first guide rod and a second guide rod at one side of the first bracing seat and the second bracing seat and adjacent to the first opening and the second opening.

* * * * *